US007811388B2

(12) United States Patent
Fisher et al.

(10) Patent No.: US 7,811,388 B2
(45) Date of Patent: Oct. 12, 2010

(54) HYDROLASING SYSTEM FOR USE IN STORAGE TANKS

(75) Inventors: Francis P. Fisher, Evergreen, CO (US); Robert Gregory Tinker, Broomfield, CO (US)

(73) Assignee: TMR Associates, LLC, Lakewood, CO (US)

( * ) Notice: Subject to any disclaimer, the term of this patent is extended or adjusted under 35 U.S.C. 154(b) by 977 days.

(21) Appl. No.: 11/608,383

(22) Filed: Dec. 8, 2006

(65) Prior Publication Data

US 2007/0137680 A1 Jun. 21, 2007

Related U.S. Application Data

(60) Provisional application No. 60/751,329, filed on Dec. 16, 2005.

(51) Int. Cl.
*B08B 3/02* (2006.01)

(52) U.S. Cl. ..... 134/167 R; 134/168 R

(58) Field of Classification Search ..... 134/167 R, 134/168 R

See application file for complete search history.

(56) References Cited

U.S. PATENT DOCUMENTS

| | | | | |
|---|---|---|---|---|
| 5,617,604 | A | 4/1997 | Erich | |
| 5,640,982 | A * | 6/1997 | Landry et al. | 134/167 R |
| 5,879,515 | A * | 3/1999 | Straub et al. | 162/275 |
| 6,051,076 | A * | 4/2000 | Oechsle et al. | 134/15 |
| 6,053,267 | A | 4/2000 | Fisher | |
| 6,102,145 | A | 8/2000 | Fisher | |
| 6,141,810 | A * | 11/2000 | Allen et al. | 15/1.7 |
| 6,898,951 | B2 | 5/2005 | Severns et al. | |
| 6,969,414 | B2 | 11/2005 | Fisher | |

FOREIGN PATENT DOCUMENTS

GB 2253814 * 3/1991

* cited by examiner

*Primary Examiner*—Frankie L Stinson
*Assistant Examiner*—Jason Heckert
(74) *Attorney, Agent, or Firm*—Dorr, Carson & Birney, P.C.

(57) ABSTRACT

A hydrolasing system for use in storage tanks includes a remotely-operated water lance having an elongated main body and an axle assembly that folds parallel to the main body so that it can be deployed and retrieved through a small-diameter riser of storage tank. After deployment, the system can be remotely operated within the tank to remove hardened salt cake.

16 Claims, 9 Drawing Sheets

Fig.10
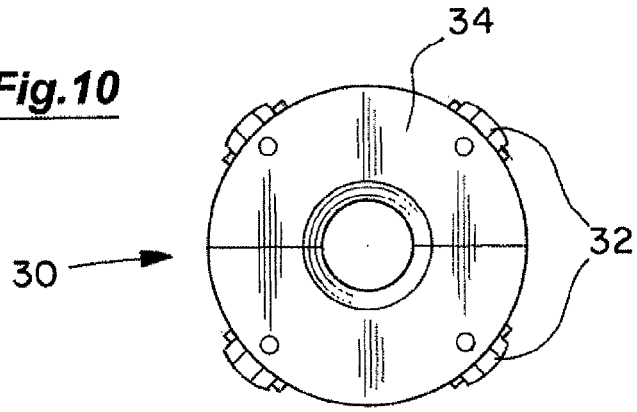
Fig. 11
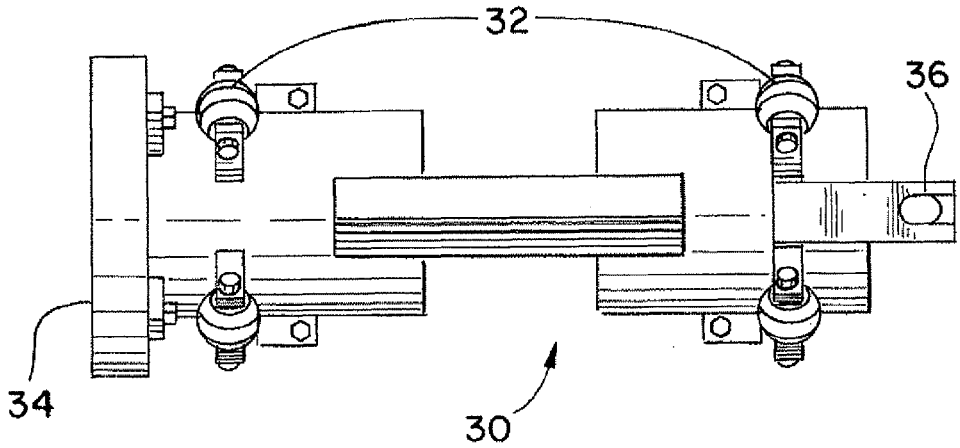
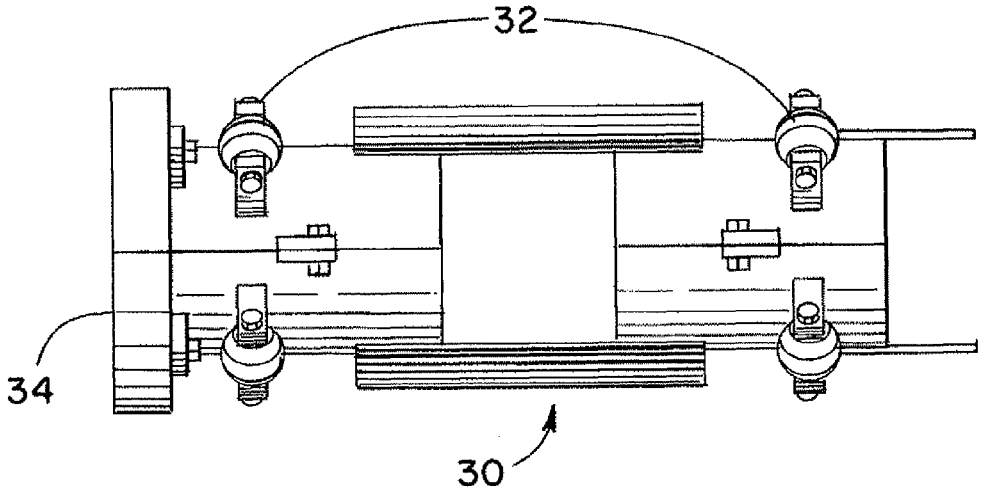
Fig. 12

HYDROLASING SYSTEM FOR USE IN STORAGE TANKS

RELATED APPLICATION

The present application is based on and claims priority to the Applicant's U.S. Provisional Patent Application 60/751,329, entitled "Hydrolasing System for Use in Storage Tanks," filed on Dec. 16, 2005.

BACKGROUND OF THE INVENTION

1. Field of the Invention

The present invention relates generally to the field of hydrolasing tools for deployment in storage tanks. More specifically, the present invention discloses a remotely-operated hydrolasing system for mobilizing hardened salt cake in large storage tanks.

2. Statement of the Problem

A number of hazardous waste storage facilities around the country have large underground storage tanks containing hardened salt cake. A problem exists in dissolving or mobilizing these salts, so that they can be removed from the storage tanks for treatment or disposal. The conventional approach has been to sluice water through the storage tanks to dissolve the salt cake. This has been less than completely satisfactory in breaking down salt cake due to the hardened nature of the salt cake and its limited solubility.

In more accessible environments, salt cake can be more effectively removed from surfaces by means of high-pressure jets of waters. This is commonly known as "hydrolasing," However, hydrolasing presents a number of major obstacles to its use in underground storage tanks and in dealing with hazardous waste. The primary obstacle is a lack of access provided when dealing with large underground storage tanks. For example, many storage tanks have a 12-inch diameter opening and a 9-foot riser leading into the interior of the tank. The bottom of the tank can be more than 50 feet below the surface of the earth. In addition, the tank may contain obstacles must be maneuvered around. These limitations create significant obstacles to deploying, operating and recovering a hydrolasing apparatus within a storage tank.

Dealing with hazardous wastes creates additional obstacles. The hydrolasing head must have sufficient power to break apart and mobilize the waste in order to be effective. However, it should be unable to penetrate the corroded steel wall of the tank, which might release hazardous waste into the surrounding environment. In addition, the hydrolasing process should minimize the generation of aerosols that can escape through the riser into the environment.

3. Solution to the Problem

The present invention addresses the shortcomings of the prior art by providing a hydrolasing system that can be readily deployed in and recovered from underground storage tanks. Once deployed within a storage tank, the hydrolasing system can be maneuvered on its drive wheels to avoid obstacles and allow careful control of the areas of the tank to be treated.

SUMMARY OF THE INVENTION

This invention provides a hydrolasing system for use in storage tanks that includes a remotely-operated water lance that folds so that it can be deployed and retrieved through a small-diameter riser. After deployment, the system can be remotely operated within the tank to remove hardened salt cake.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 10 is a bottom plan view of the RAT 30 corresponding to FIG. 9.

FIGS. 11 and 12 are orthogonal side elevational views of the RAT 30 corresponding to FIGS. 9 and 10.

DETAILED DESCRIPTION OF THE INVENTION

Figure 1:
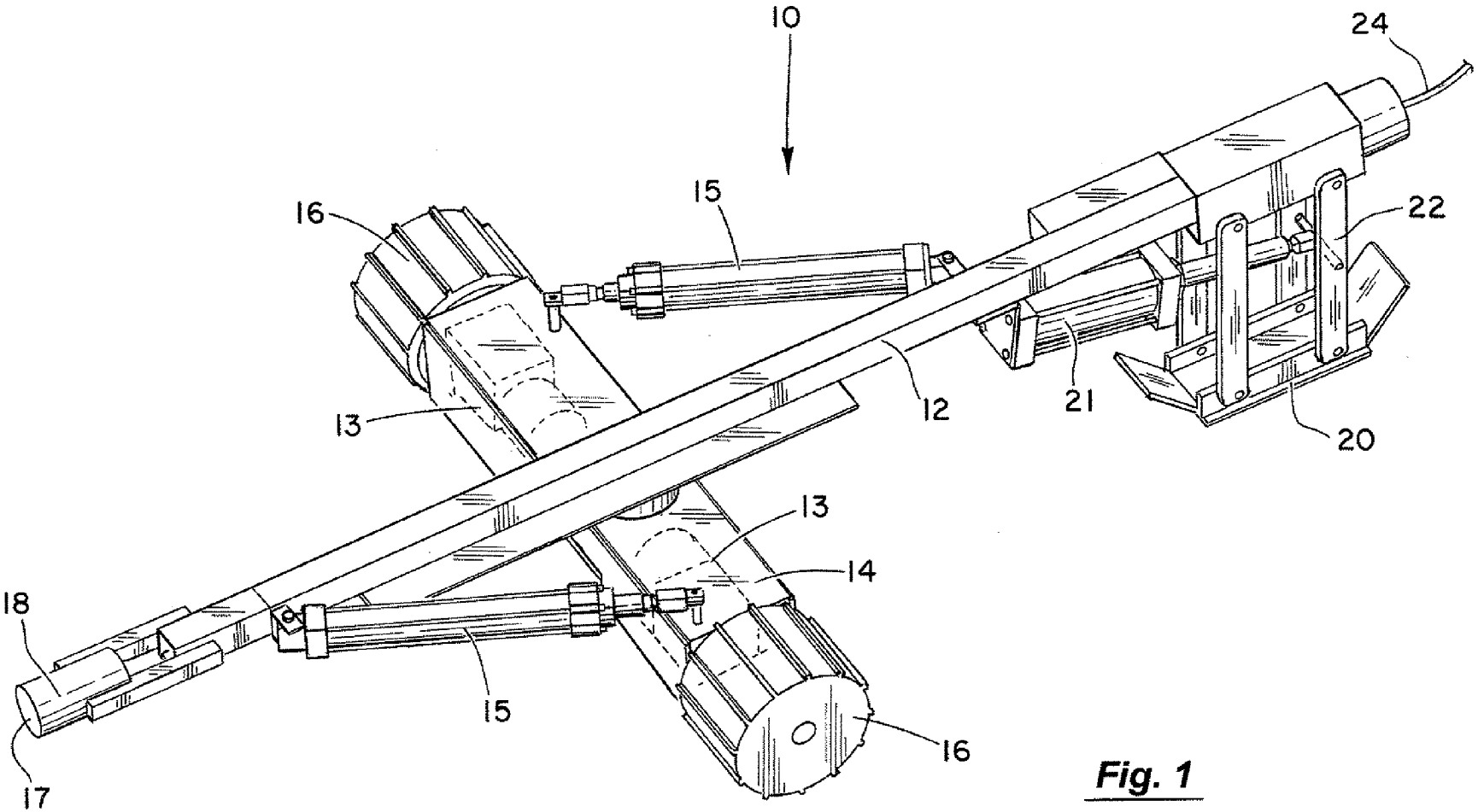
FIG. 1 is a perspective view of the remotely-operated water lance (ROWL) 10 in its unfolded state.
Figure 2:
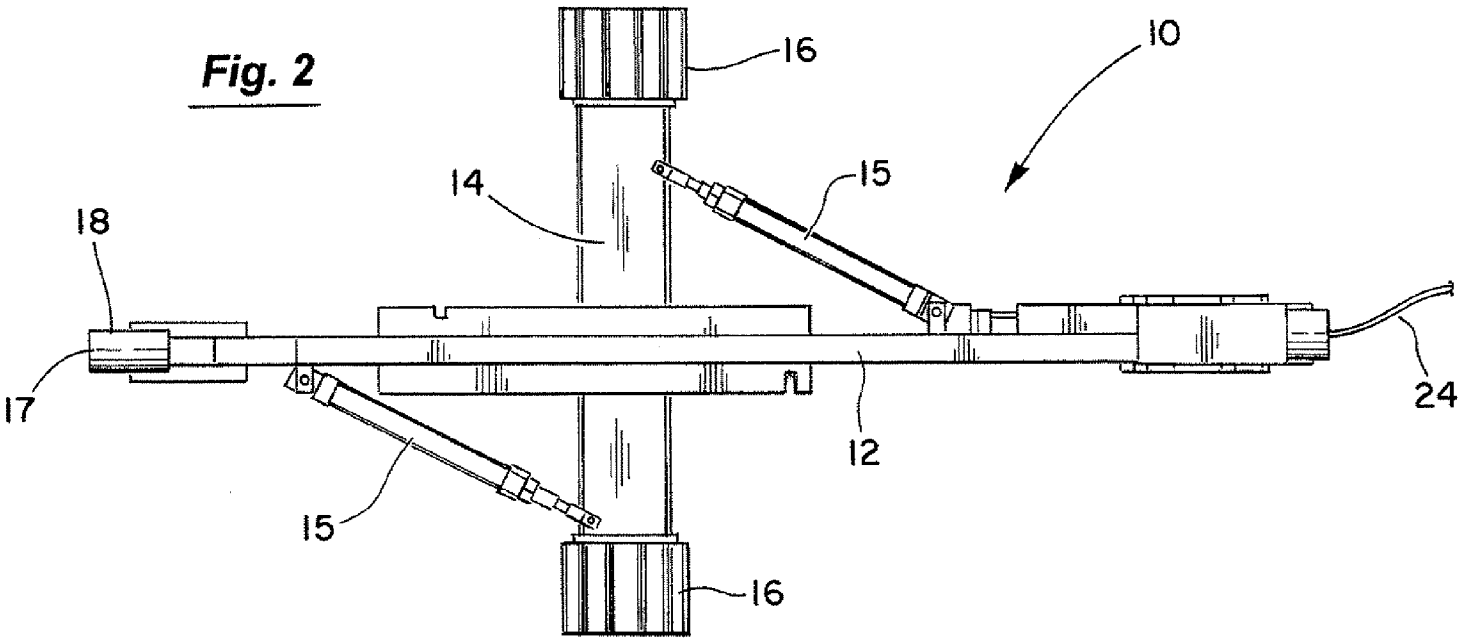
FIG. 2 is a top plan view of the ROWL 10 corresponding to FIG. 1.
Figure 3:
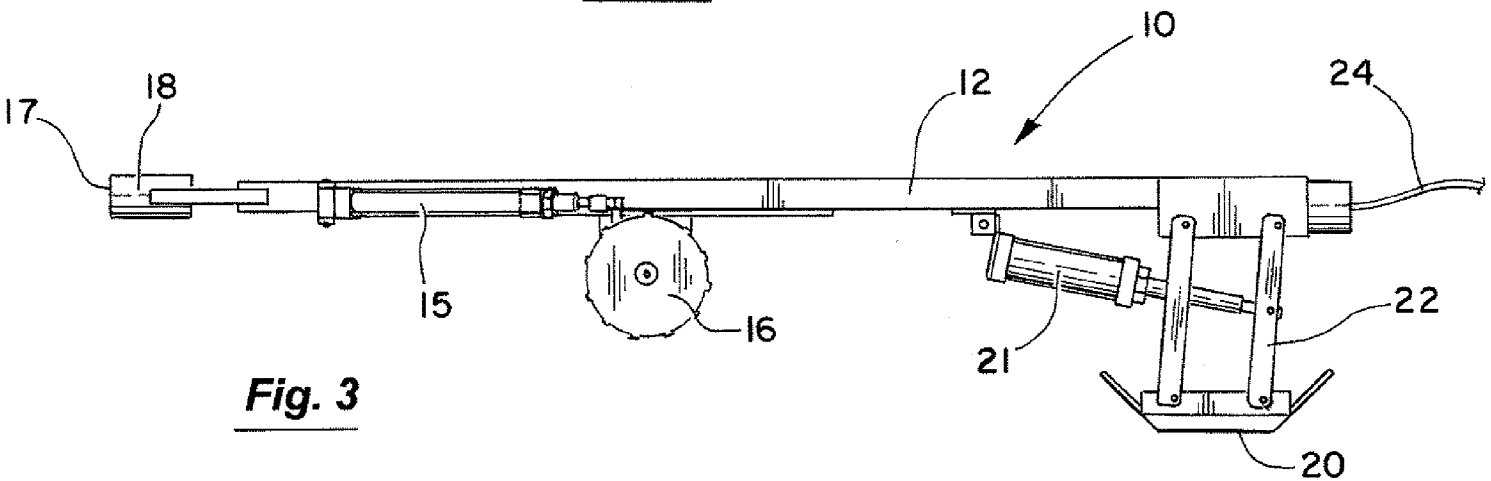
FIG. 3 is a side elevational view of the ROWL 10 corresponding to FIGS. 1 and 2.

Remotely-Operated Water Lance. Turning to FIG. 1, a perspective view is provided of the remotely-operated water lance 10, or ROWL, in its unfolded state. FIG. 2 is a corresponding top plan view and FIG. 3 is a corresponding side elevational view of the ROWL 10. The ROWL consists of three basic parts, the main body 12, the axle assembly 14, and the hydrolasing head 17. For example, the main body 12 can be fabricated with welded stainless steel plate and angle brackets to form an elongated structure having a hollow core and minimal cross-sectional dimensions allowing the main body 12 to be inserted through a conventional small-diameter riser of a tank. The hollow core of the main body 12 houses the pneumatic air lines, the high-pressure hose, and the tether. The tether is a ⅜ in. cable and is designed to support the full weight of the assembly.

The hydrolasing head 17 is typically mounted near the distal end of the main body 12, as shown in the figures. The hydrolasing head 17 can be driven by reaction-type nozzles, for example, so that the head is self-rotating. Rotation is imparted by the angular setting of the nozzles in the hydrolasing head 17, thereby eliminating the need for separate drive motors. An integral swivel assembly can be employed to allow for free rotation of the hydrolasing head 17 during operation. The attained rotational speed is dependent on applied resistance of the fluid media in which it operates, the primary resistances being offered by the depth under water and the suspended and dissolved salts concentrations. Alternatively, fixed nozzles could be used in place of, or in addition to a rotating hydrolasing head.

Figure 8:
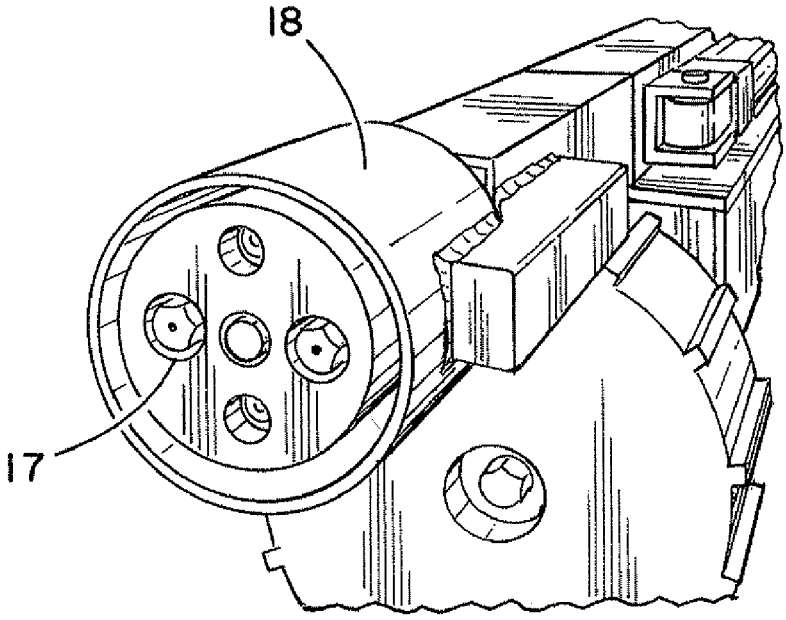
FIG. 8 is a photograph of the front end of the ROWL 10 including the hydrolasing head 17.
Figure 9:
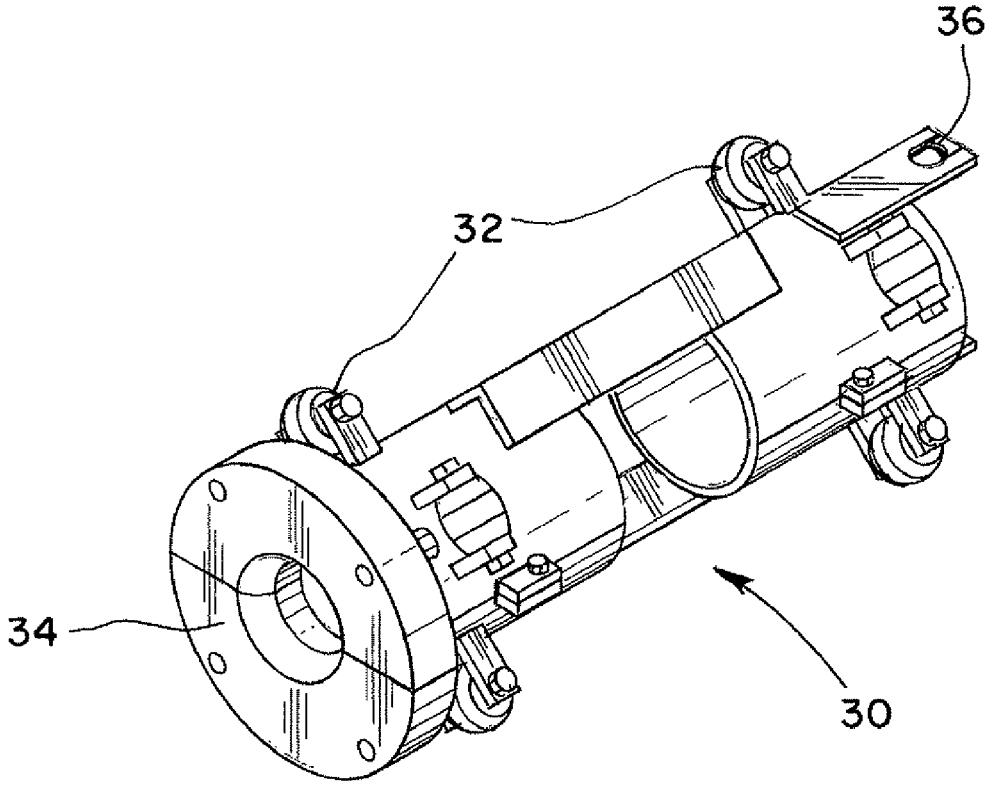
FIG. 9 is a perspective view of the rotating alignment tool (RAT) 30.

The hydrolasing head 17 itself is protected by a non-rotating cage 18. The purpose of the protective cage 18 is two-fold. First, it protects the nozzles from impacting with the tank steel bottom and salt cake. Second, it establishes the required standoff of the nozzles relative to the target material and protects the steel plate from direct contact. FIG. 8 is a photograph of the front end of the ROWL 10 showing the hydrolasing head 17 and protective cage 18.

The ROWL 10 is connected to the surface by an umbilical 24 extending from the hollow core near the proximal end of the main body 12 (i.e., through the tail of the ROWL 10). The umbilical 24 contains pneumatic air lines for actuation of the various hydraulic cylinders and motors, a high-pressure hose, and the tether cable. Thus, the high-pressure nozzles of the hydrolasing head 17 are supplied by the high-pressure hose passing through the main body 12 of the ROWL 10, up the umbilical 24, and to an external high-pressure pump. In the preferred embodiment, the ROWL 10 is entirely pneumatic. However, other configurations could be readily substituted. The hydrolasing head 17 can also be selectively activated and deactivated remotely from a control station outside the tank via the umbilical 24. In addition, the umbilical 24 serves as a flexible connection for inserting and withdrawing the hydrolasing system through the tank riser, as will be discussed below.

Figure 4:
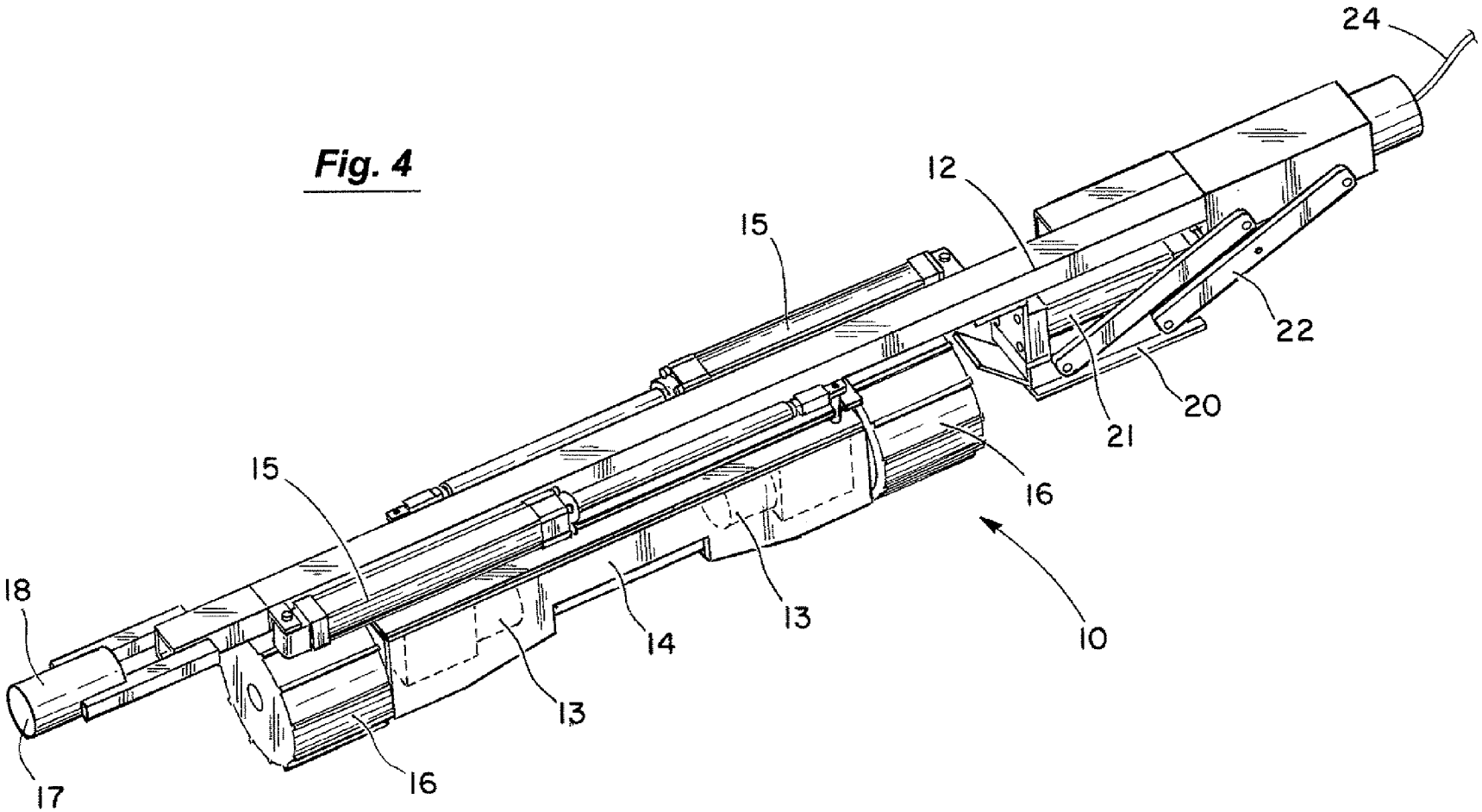
FIG. 4 is a perspective view of the ROWL 10 in the folded state.
Figure 6:
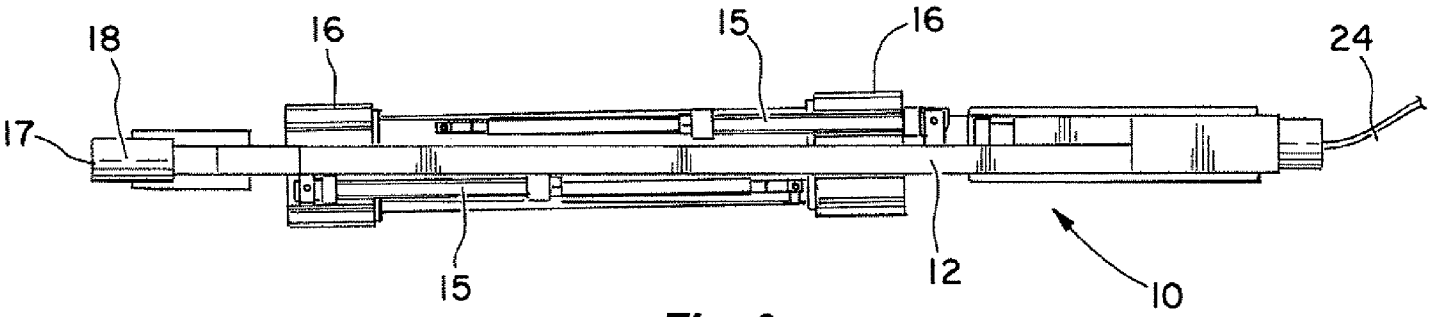
FIG. 6 is a top plan view of the ROWL 10 corresponding to FIGS. 4 and 5.
Figure 5:
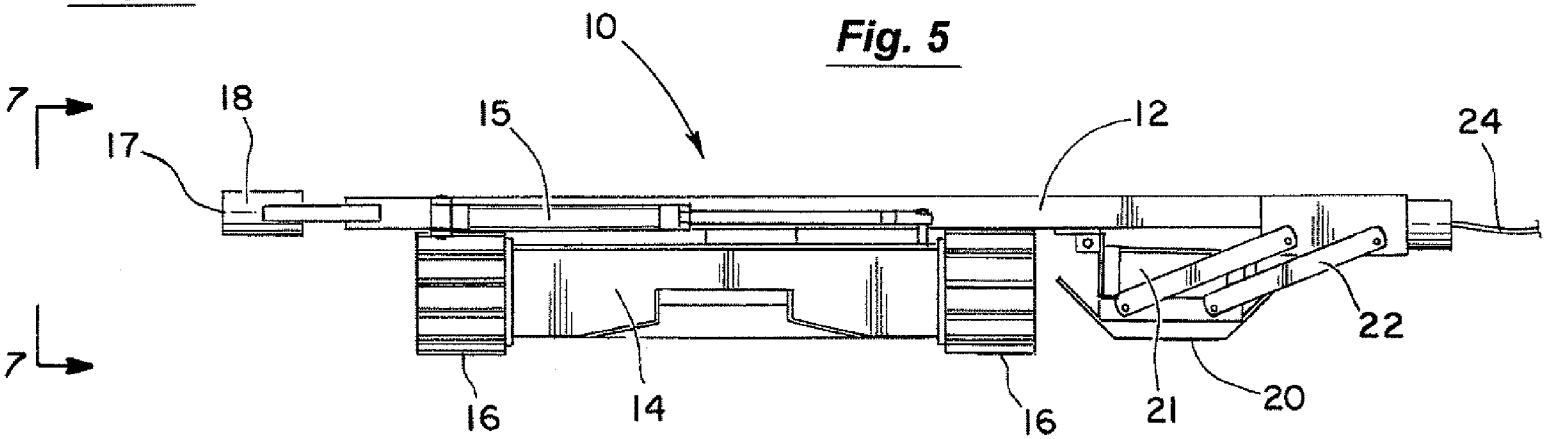
FIG. 5 is a side elevational view of the ROWL 10 corresponding to FIG. 4.
Figure 7:
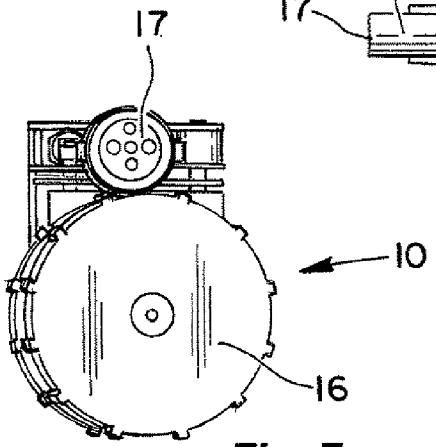
FIG. 7 is a front elevational view of the ROWL 10 corresponding to FIGS. 4-6.

The axle assembly is movably mounted to the mid-section of the main body 12 as illustrated for example in FIGS. 1 and 4. In the unfolded state shown in FIGS. 1-3, the axle assembly 14 is unfolded and extends laterally outward from the main body 12 of the ROWL 10 in preparation for operation in a tank. In the specific embodiment shown in the accompanying drawings, the axle assembly 14 pivots out of parallel alignment with the main body 12 by means of a pair of pneumatic cylinders 15 to a fully unfolded state in which the axle assembly 14 is generally perpendicular to the axis of the main body 12 of the ROWL 10. This is the normal position for operation of the ROWL 10 on the tank floor. Alternatively, hydraulic cylinders, electric motors, or other types of actuators could be readily substituted to move the axle assembly 14 between its folded and unfolded states.

For example, the axle assemble 14 can be equipped with two wheels 16 driven by two independent pneumatic radial piston motors 13 within the axle assembly 14 to support and maneuver the unfolded ROWL 10 in the tank. The pneumatic lines for the drive motors 13 are routed through the interior of the axle assembly 14 and main body 12 of the ROWL 10, and up the umbilical 24 to the control station. Alternatively, the drive motors 13 could be powered hydraulically or by electricity. The drive motors 13 are operated remotely from the control station while the operator observes via a number of video cameras. The cameras can either be mounted to the ROWL or separately lowered into the tank.

FIGS. 4 through 7 depict the ROWL 10 in the folded position. In the embodiment shown in the drawings, the ROWL 10 is approximately 8-feet in length and 10½-inches in diameter in its folded state. Notice that the pneumatic cylinder rods 15 on either side of the axle assembly 14 are fully retracted to move the axle assembly 14 into an orientation generally parallel to the axis of the main body 12 of the ROWL 10. The rear foot braces 22 are also folded against the main body 12 of the ROWL 10 to minimize the unit's cross-section, as shown in FIGS. 4-7. After the ROWL 10 has been lowered into the storage tank, two pneumatic cylinders 15 on opposing sides of the main body 12 of the ROWL 10 can be activated to unfold the axle assembly 14, as previously discussed. The folded state is the default, fail-safe position and allows the ROWL 10 to be lowered through the riser into the storage tank or retrieved from the tank. For example, the slim profile allows the unit to pass through a nominal 12-inch diameter pipe. The cylinders 15 can be deactivated to bleed off air, which due to the weight of the axle assembly 14, returns the ROWL 10 to its folded state. Should a loss of air or other mechanical malfunction occur, air pressure is released to return the ROWL to its default folded state. The ROWL 10 can then be retrieved up the riser in its folded state by reeling in the umbilical 24.

In the unfolded position of the embodiment shown in the accompanying drawings, a tail foot 20 can also be extended from the proximal end of the main body 12 of the ROWL 10. A pneumatic cylinder 21 serves as a foot actuator to position the rear foot braces 22 and thereby raise and lower the ROWL's tail. The axle assembly 14, acting as the pivot point translates this into up/down movement of the hydrolasing head 17 at the front of the main body 12. Thus, the elevation of the hydrolasing head 17 within the storage tank can be adjustably controlled by actuation of the pneumatic cylinder 21. It should be understood that other types of foot actuators could be substituted to adjust the elevation of the hydrolasing head 17.

Rotating Alignment Tool. FIGS. 10 through 12 show a rotating alignment tool (RAT) 30 that is placed over the hose reel just above the ROWL 10 as the ROWL 10 is lowered into the storage tank riser. The RAT 30 is separately tethered by a hand-operated winch and is lowered into the riser after the ROWL 30 has passed. Its purpose is to align the ROWL 10 to the deflection offered by the riser (e.g., as much as 3 degrees). The RAT 30 is approximately 30-inches long and has an approximate 11½-inch diameter. The unit has four alignment casters 32 on each end equally spaced around its perimeter to align the RAT 30 and ROWL 10 as they pass through riser of the storage tank. A tether eyelet 36 is provided on the upper end of the RAT 30 and a receiving plate 34 is provided on the lower end of the RAT 30 to abut the ROWL 10. The receiving plate 34 has an opening to allow passage of the umbilical 24 for the ROWL 10. The RAT 30 is usually only used for deployment and retrieval of the ROWL 10 and typically does not extends beyond the bottom of the tank riser.

Figure 13:
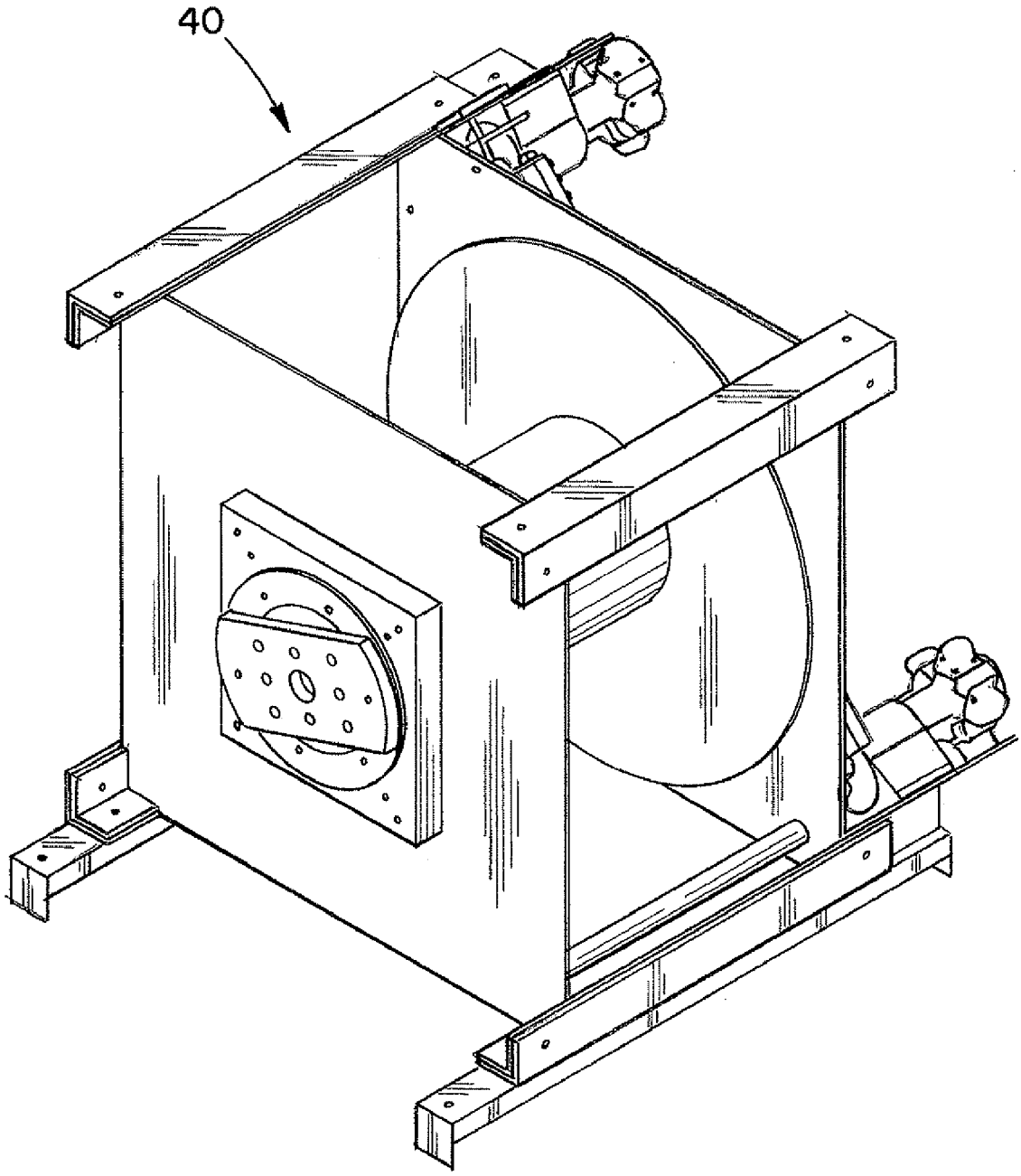
FIG. 13 is a perspective view of the hose reel 40 of the umbilical management system.

Umbilical Management System. FIG. 13 shows the hose reel 40, which is the major component of the umbilical management system. The hose reel 40 plays out the umbilical 24 attached to the ROWL 10. The hose reel 40 is driven by two opposed pneumatic radial piston motors. The motors are connected by a chain-driven sprocket attached to the reel hub. A disc brake is provided on the opposite side of the hose reel to hold position when the drive motors are off-line. The disc brakes are interconnected such that they are activated when the motors are deactivated. The disc brakes are normally locked when the load is not in motion.

Figure 14:
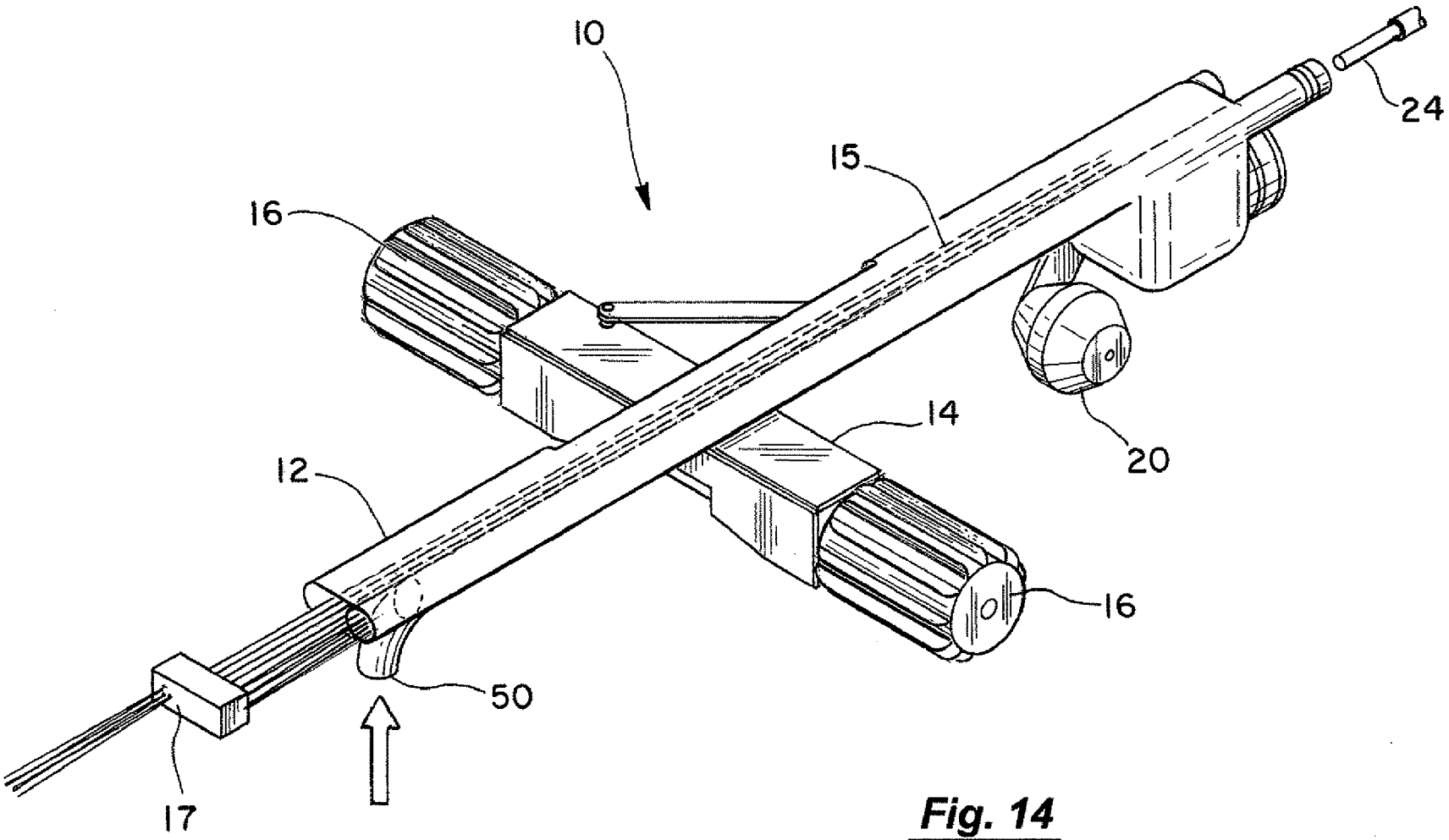
FIG. 14 is a front perspective view of another embodiment of a ROWL 10 with a suction feature.
Figure 15:
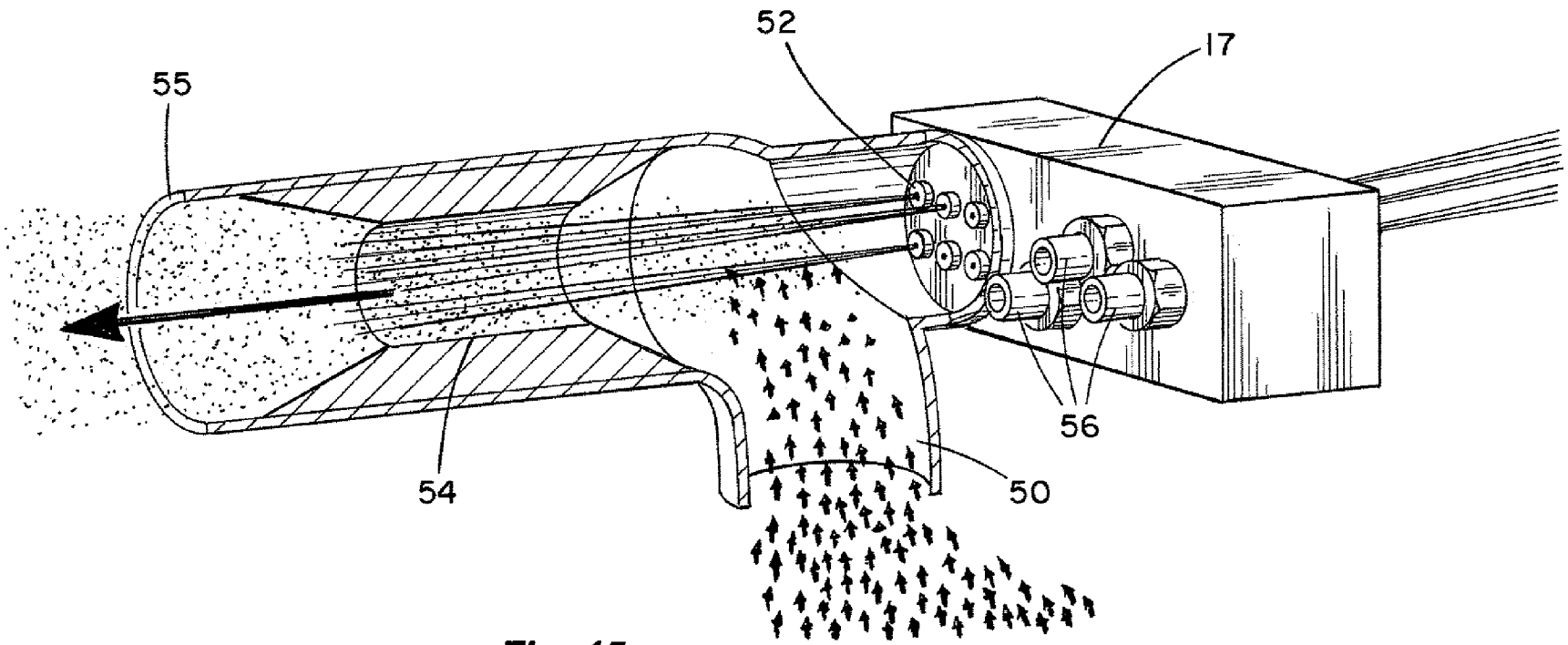
FIG. 15 is a detail rear perspective view of the suction section of the embodiment of the ROWL 10 shown in FIG. 14 with a portion of the suction port 50 and discharge tube 55 cut away.

Suction Feature. FIGS. 14 and 15 illustrate another embodiment of the ROWL 10 that includes a suction section at the distal end of the main body 12 for transferring waste materials (i.e., liquid and suspended solids) out of the tank. FIG. 14 is a front perspective view of this embodiment and FIG. 15 is a detail rear perspective view of the suction section with a portion of the suction port 50 and discharge tube 55 cut away. A number of rearward-facing nozzles 52 shoot jets of high-pressure fluid supplied via the umbilical 24 through a discharge tube 55 toward the proximal end (i.e., tail) of the ROWL 10. The high-pressure, high-velocity jets create a zone of low pressure at the suction port 50. Liquid and suspended solids are drawn upward from the tank through the suction port 50 and into the discharge tube 55. The force of the high-pressure fluid expelled through the nozzles 52 tends to pulverize any entrained solids to reduce their particle size and help prevent clogging. The flow exits the tank through a hose or lumen in the umbilical 24.

Optionally, an initial section 54 of the discharge tube 55 adjacent to the suction port 50 can be constricted to a reduced inside diameter to accelerate the flow. This constricted region can be lined with a ceramic material, hardened steel or other abrasion-resistant materials to reduce abrasion on the remainder of the interior of the discharge tube 55. Preferably, the constricted region should create a narrow, cohesive, laminar stream to keep the abrasive materials entrained in the stream (e.g., sand) away from the pipe walls and hosing downstream.

The main body 12 in the embodiment shown in FIGS. 14 and 15 is partitioned into two parallel channels running the full length of the unit and culminating at the nozzle block assembly housing both sets of nozzles 17 and 52. One channel accommodates high-pressure water hoses from the umbilical 24, each connecting to individual high-pressure fittings 56 in the nozzle block assembly shown in FIG. 15 to supply the forward hydrolasing head nozzles 17 and rearward-facing nozzles 52. The second channel accommodates the waste transfer system by carrying high-pressure water hoses from the umbilical 24 to other high-pressure fittings 56 on the nozzle block assembly (shown in FIG. 15) that supply the rearward-facing nozzles 52.

The embodiment shown in FIGS. 14 and 15 also employs a different type of rear foot 20 to support and elevate the tail end of the main body 12. In particular, the rear foot 20 includes a wheel mounted on an elongated member that is pivotally mounted to a hydraulic motor on the main body. The wheel can freely rotate to reduce drag as the ROWL 10 maneuvers within a tank.

Method of Operation. The ROWL 10 is deployed through the riser in its folded configuration and is lowered to the tank floor by its umbilical 24 with the umbilical management system. The rotary alignment tool (RAT) 30, operating in conjunction with the umbilical management system, ensures proper alignment of the ROWL 10 during deployment and retrieval.

When the ROWL 10 clears the bottom of the tank riser, it can be unfolded into its operating configuration, as shown in FIGS. 1 through 3. The ROWL 10 is designed to land on its wheels in a stance for operation. To do this, the ROWL 10 is configured with small diameter wheels 16, pneumatic cylinders 15, 21 for folding and unfolding, additional weight for stability, and an articulating hydrolasing head 17.

The ROWL 10 is designed for travel on the tank bottom in the unfolded position, and uses high pressure water supplied through the umbilical 24 to the hydrolasing heads 17 to break apart the salt cake and mobilize (and consequently saturate) the solution. It is anticipated that the best operating configuration will be submerged approximately 6-inches below the surface of the water with the salt cake also submerged. This will allow a rather vigorous boil to occur and keeps much of the salt in solution for pumping.

As previously discussed, the embodiment of the ROWL 10 shown in FIGS. 14 and 15 includes a suction section that enables the system to also pump the resulting solution and suspended solids out of the tank. To activate suction, the operator opens the appropriate valves to supply high-pressure fluid for the rearward-facing jets 52. The tail foot 20 can be manipulated by the operator to control the elevation of the suction port 50, and the wheels can be used to move the ROWL 10 around within the tank. It should be noted that the suction feature can be used simultaneously with the hydrolasing operation or each mode of operation can be separately used.

Following completion of hydrolasing operations in a storage tank, the ROWL 10 can be returned to its folded state by releasing the air pressure from its pneumatic cylinders 15 and 21, which allows the axle assembly 14 to rotate to an orientation generally parallel to the main body 12 of the ROWL 10, and retracts the tail foot 20. The ROWL 10 can then be retrieved up the riser in its folded state by reeling in the umbilical 24.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A hydrolasing system for use in a tank having a small-diameter riser, said hydrolasing system comprising:

an elongated main body having proximal and distal ends;

a hydrolasing head on the distal end of the main body;

an axle assembly movably mounted to the main body having:

(a) at least one actuator moving the axle assembly between:

(i) a folded state in which the axle assembly is substantially parallel to the main body to fit through a riser; and (ii) an unfolded state in which the axle assembly extends laterally outward from the main body;

(b) wheels; and (c) at least one drive motor driving the wheels to maneuver the hydrolasing system within a tank in the unfolded state;

an umbilical supplying fluid to the hydrolasing head and providing a flexible connection extending from the proximal end of the main body for retrieving the hydrolasing system through a riser;

a tail foot extending from the proximal end of the main body; and a foot actuator adjustably controlling the elevation of the proximal end of the main body above the tail foot, and thereby adjustably controlling the elevation of the hydrolasing head.

2. The hydrolasing system of claim 1 wherein the axle assembly is pivotally mounted to the main body.

3. The hydrolasing system of claim 1 further comprising a suction section having:

a discharge tube extending along the main body;

at least one nozzle directing a jet of fluid along the interior of the discharge tube; and a suction port in the discharge tube adjacent to the nozzle drawing adjacent fluid into the discharge tube.

4. The hydrolasing system of claim 3 wherein the discharge tube further comprises a constricted region adjacent to the suction port having a reduced inside diameter to accelerate the flow.

5. The hydrolasing system of claim 4 wherein the constricted region further comprises a ceramic lining.

6. The hydrolasing system of claim 1 wherein the drive motor comprises a pneumatic motor.

7. The hydrolasing system of claim 1 wherein the actuator moving the axle assembly comprises a pneumatic cylinder.

8. A hydrolasing system for use in a tank having a small-diameter riser, said hydrolasing system comprising:

an elongated main body having proximal and distal ends;

a hydrolasing head on the distal end of the main body;

an axle assembly pivotally mounted to the main body having:

(a) at least one actuator rotating the axle assembly with respect to the main body between: (i) a folded state in which the axle assembly is substantially parallel to the main body to fit through a riser; and (ii) an unfolded state in which the axle assembly extends laterally outward from the main body;

(b) wheels; and (c) at least one drive motor driving the wheels to maneuver the hydrolasing system within a tank in the unfolded state;

an umbilical supplying fluid to the hydrolasing head and providing a flexible connection extending from the proximal end of the main body for retrieving the hydrolasing system through a riser;

a tail foot extending from the proximal end of the main body; and a foot actuator adjustably controlling the elevation of the proximal end of the main body above the tail foot, and thereby adjustably controlling the elevation of the hydrolasing head.

9. The hydrolasing system of claim 8 further comprising a suction section having:

a discharge tube extending along the main body;

at least one nozzle directing a jet of fluid along the interior of the discharge tube; and a suction port in the discharge tube adjacent to the nozzle drawing fluid from the tank into the discharge tube.

10. The hydrolasing system of claim 9 wherein the discharge tube further comprises a constricted region adjacent to the suction port having a reduced inside diameter to accelerate the flow.

11. The hydrolasing system of claim 10 wherein the constricted region further comprises a ceramic lining.

12. The hydrolasing system of claim 8 wherein the drive motor comprises a pneumatic motor.

13. The hydrolasing system of claim 8 wherein the actuator moving the axle assembly comprises a pneumatic cylinder.

14. A hydrolasing system for use in a tank having a small-diameter riser, said hydrolasing system comprising:

an elongated main body having proximal and distal ends;

a hydrolasing head on the distal end of the main body;

an axle assembly movably mounted to the main body having:

(a) at least one actuator moving the axle assembly between: (i) a folded state in which the axle assembly is substantially parallel to the main body to fit through a riser; and (ii) an unfolded state in which the axle assembly extends laterally outward from the main body;

(b) wheels; and (c) at least one drive motor driving the wheels to maneuver the hydrolasing system within a tank in the unfolded state;

a suction section having:

(a) a discharge tube extending along the main body;

(b) at least one nozzle directing a jet of fluid along the interior of the discharge tube; and (c) a suction port in the discharge tube adjacent to the nozzle drawing fluid from the tank into the discharge tube;

an umbilical supplying fluid to the hydrolasing head, removing fluid from the suction section, and providing a flexible connection extending from the proximal end of the main body for retrieving the hydrolasing system through a riser;

a tail foot extending from the proximal end of the main body; and a foot actuator adjustably controlling the elevation of the proximal end of the main body above the tail foot, and thereby adjustably controlling the elevation of the hydrolasing head.

15. The hydrolasing system of claim 14 wherein the axle assembly is pivotally mounted to the main body.

16. The hydrolasing system of claim 14 wherein the discharge tube further comprises a constricted region adjacent to the suction port having a reduced inside diameter to accelerate the flow.

* * * * *